US006685600B1

(12) United States Patent
Ullman

(10) Patent No.: US 6,685,600 B1
(45) Date of Patent: Feb. 3, 2004

(54) EXERCISE ACCESSORY DEVICE, KIT AND METHOD OF USING

(76) Inventor: Stuart G. Ullman, 4008 Brainard Ave., Kensington, MD (US) 20895

( * ) Notice: Subject to any disclaimer, the term of this patent is extended or adjusted under 35 U.S.C. 154(b) by 0 days.

(21) Appl. No.: 10/317,379

(22) Filed: Dec. 11, 2002

(51) Int. Cl.[7] ..... A63B 21/062

(52) U.S. Cl. ..... 482/103; 482/100; 482/138; 482/908; 482/101

(58) Field of Search ..... 482/100, 103, 482/138, 908, 107

(56) References Cited

U.S. PATENT DOCUMENTS

| | | | | | |
|---|---|---|---|---|---|
| 4,149,713 | A | * | 4/1979 | McLeod | 482/101 |
| 4,640,268 | A | * | 2/1987 | Roberts | 601/24 |
| 4,898,381 | A | * | 2/1990 | Gordon | 482/103 |
| 5,018,725 | A | * | 5/1991 | Cook | 482/103 |
| 5,102,122 | A | * | 4/1992 | Piane et al. | 482/133 |
| 5,151,070 | A | * | 9/1992 | Norman | 482/99 |
| 5,984,836 | A | * | 11/1999 | Casali | 482/10 |
| 6,102,836 | A | * | 8/2000 | Person | 482/103 |
| 6,106,437 | A | * | 8/2000 | Brooks | 482/10 |
| 6,165,110 | A | * | 12/2000 | Gajda | 482/102 |
| 6,217,493 | B1 | * | 4/2001 | Spletzer | 482/103 |
| 6,280,361 | B1 | * | 8/2001 | Harvey et al. | 482/8 |
| 2003/0027694 | A1 | * | 2/2003 | Harrison | 482/94 |

FOREIGN PATENT DOCUMENTS

WO WO 02/28487 A1 * 4/2002

* cited by examiner

*Primary Examiner*—Nicholas D. Lucchesi
*Assistant Examiner*—Victor Hwang

(57) ABSTRACT

An exercise accessory device, kit and associated method of using the kit for assembling the device for attachment to an exercise machine is disclosed, in which the exercise machine having at least two upper pulleys connected to a resistive force element via a system of wire ropes. The device comprises a top and bottom brace, a pair of bolts and nuts, a pair of semicircular beams, a pair of track pulleys, a pair of handle grips, and a pair of cables. The top and bottom braces are attachable to a respective top and bottom portions of the exercise machine. The pair of semicircular beams is pivotally attached to the top and bottom braces in which the pair of semicircular beams defines a perimeter of an imaginary sphere between the top and bottom braces in which the semicircular beams are locked in place to the top and bottom braces with the pair of bolts and nuts. Each semicircular beam has an inside edge comprising a slide rail with a plurality of holes traversing into the inside edge of each semicircular beam. The each track pulley includes a slide track base, a lock pin, a swivel arm, a yoke, an axle, and a wheel. The slide track base is slidably attached to the slide rail of anyone semicircular beam. The lock pin traverses through the orifice of the slide track base wherein the distal end of the lock pin is slidably insertable into anyone hole in semicircular beam. The swivel arm is attached to the slide track base. The yoke is attached to the swivel arm. The axle is attached to the yoke. The wheel is attached to the axle. The distal end of each cable is attached to the resistive force element of the exercise machine. The proximate end of each cable is attached to anyone handle grip. The middle portion of each cable is slidably connected to anyone track pulley of the device and slidably connected to anyone upper pulley of the exercise machine. The kit comprises the unattached constituents of the device. The method comprises the steps of adjoining, affixing, joining, linking, obtaining, positioning, pushing, securing, sliding, and threading.

16 Claims, 4 Drawing Sheets

EXERCISE ACCESSORY DEVICE, KIT AND METHOD OF USING

FIELD OF THE INVENTION

The present invention relates exercise equipment more particularly to an exercise accessory device, kit and method of using the kit to assemble the device onto an exercise machine having at least two upper pulleys connected to a resistive force element via a system of wire ropes.

DESCRIPTION OF THE PRIOR ART

In the past, exercise equipment was generally designed for use by a single individual or occasionally requiring use by a spotter. Many types of equipment were difficult or time consuming to set up for use by a single individual and restricted the degrees of freedom to exercise or stretch various muscles throughout the body. It is now widely recognized that proper stretching and exercising of the muscles is an important aspect to overall fitness and health. However, most known exercising and stretching devices simply provide angularly limited means for allowing an individual to exercise muscles by narrow constraining the possible movements within any given the exercise device.

A wide variety of exercise equipment is currently available on the commercial market and an even larger number of these types of devices are known in the art of exercise equipment, for example, the cooperative exercising apparatus disclosed by Jensen in U.S. Pat. No. 4,634,118; the exerciser for diseased and/or aged people's arms and legs disclosed by Chen in U.S. Pat. No. 4,993,407; the leg and arm exerciser disclosed by Morgenstein in U.S. Pat. No. 5,419,749; the stretching machine disclosed by Sabel in U.S. Pat. No. 5,449,336; the computerized exercise system and method disclosed by Harvey et al. in U.S. Pat. No. 6,280,361; and the physical exercise stand disclosed by Gifford in U.S. Pat. No. D368,747.

While all of the above-described devices fulfill their respective, particular objectives and requirements, the aforementioned patents do not describe an exercise accessory device having a pair of semicircular beams is pivotally attached to the top and bottom braces in which the pair of semicircular beams defines a perimeter of an imaginary sphere between the top and bottom braces in which the semicircular beams are locked in place to the top and bottom braces with the pair of bolts and nuts. This combination of elements would specifically match the user's particular individual needs of making it possible to angularly change the angles of each semicircular beam relative to the top and bottom braces by loosening the bolts and nuts in order to provide a user an infinite number of angles for use in exercising muscles with this exercise accessory device attached to an exercise machine. The above-described patents make no provision for an exercise accessory device having a pair of semicircular beams is pivotally attached to the top and bottom braces in which the pair of semicircular beams defines a perimeter of an imaginary sphere between the top and bottom braces in which the semicircular beams are locked in place to the top and bottom braces with the pair of bolts and nuts.

Therefore, a need exists for a new and improved exercise accessory device having an exercise accessory device having a pair of semicircular beams is pivotally attached to the top and bottom braces in which the pair of semicircular beams defines a perimeter of an imaginary sphere between the top and bottom braces in which the semicircular beams are locked in place to the top and bottom braces with the pair of bolts and nuts. In this respect, the exercise accessory device according to the present invention substantially departs from the conventional concepts and designs of the prior art, and in doing so provides an apparatus primarily developed for the purpose of providing a means for angularly changing the angles of each semicircular beam relative to the top and bottom braces by loosening the bolts and nuts in order to provide a user an infinite number of angles as a means for exercising muscles with this exercise accessory device attached to an exercise machine.

SUMMARY OF THE INVENTION

The present device, kit and method of using, according to the principles of the present invention, overcomes the shortcomings of the prior art by providing a exercise accessory device, kit and method of using is disclosed. The device comprises a top and bottom brace, a pair of bolts and nuts, a pair of semicircular beams, a pair of track pulleys, a pair of handle grips, and a pair of cables. The top and bottom braces are attachable to a respective top and bottom portions of the exercise machine. The pair of semicircular beams is pivotally attached to the top and bottom braces in which the pair of semicircular beams defines a perimeter of an imaginary sphere between the top and bottom braces in which the semicircular beams are locked in place to the top and bottom braces with the pair of bolts and nuts. Each semicircular beam has an inside edge comprising a slide rail with a plurality of holes traversing into the inside edge of each semicircular beam. The each track pulley includes a slide track base, a lock pin, a swivel arm, a yoke, an axle, and a wheel. The slide track base is slidably attached to the slide rail of anyone semicircular beam. The lock pin traverses through the orifice of the slide track base wherein the distal end of the lock pin is slidably insertable into anyone hole in semicircular beam. The swivel arm is attached to the slide track base. The yoke is attached to the swivel arm. The axle is attached to the yoke. The wheel is attached to the axle. The distal end of each cable is attached to the resistive force element of the exercise machine. The proximate end of each cable is attached to anyone handle grip. The middle portion of each cable is slidably connected to anyone track pulley of the device and slidably connected to anyone upper pulley of the exercise machine. The kit comprises the unattached constituents of the device. The method comprises the steps of adjoining, affixing, joining, linking, obtaining, positioning, pushing, securing, sliding, and threading.

In view of the foregoing disadvantages inherent in the known type exercise devices now present in the prior art, the present invention provides an improved exercise accessory device, which will be described subsequently in great detail, is to provide a new and improved exercise accessory device which is not anticipated, rendered obvious, suggested, or even implied by the prior art, either alone or in any combination thereof.

To attain this, the present invention essentially comprises a top and bottom brace, a pair of bolts and nuts, a pair of semicircular beams, a pair of track pulleys, a pair of handle grips, and a pair of cables. The top and bottom braces are attachable to a respective top and bottom portions of the exercise machine. The pair of semicircular beams is pivotally attached to the top and bottom braces in which the pair of semicircular beams defines a perimeter of an imaginary sphere between the top and bottom braces in which the semicircular beams are locked in place to the top and bottom braces with the pair of bolts and nuts. Each semicircular beam has an inside edge comprising a slide rail with a plurality of holes traversing into the inside edge of each semicircular beam. The each track pulley includes a slide track base, a lock pin, a swivel arm, a yoke, an axle, and a wheel. The slide track base is slidably attached to the slide rail of anyone semicircular beam. The lock pin traverses through the orifice of the slide track base wherein the distal end of the lock pin is slidably insertable into anyone hole in semicircular beam. The swivel arm is attached to the slide track base. The yoke is attached to the swivel arm. The axle is attached to the yoke. The wheel is attached to the axle. The distal end of each cable is attached to the resistive force element of the exercise machine. The proximate end of each cable is attached to anyone handle grip. The middle portion of each cable is slidably connected to anyone track pulley of the device and slidably connected to anyone upper pulley of the exercise machine.

There has thus been outlined, rather broadly, the more important features of the invention in order that the detailed description thereof that follows may be better understood, and in order that the present contribution of the art may be better appreciated.

The invention may also include a bench positionable between the top and bottom braces. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise accessory device that has all the advantages of the prior art exercise accessory device and none of the disadvantages.

It is another object of the present invention to provide a new and improved exercise accessory device that may be easily and efficiently manufactured and marketed.

An even further object of the present invention is to provide a new and improved exercise accessory device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new exercise accessory device that provides in the apparatuses and methods of the prior art some of the advantages thererof, while simultaneously overcoming some of the disadvantages normally associated therewith.

Even still another object of the present invention is to provide a exercise accessory device having a pair of semicircular beams is pivotally attached to the top and bottom braces in which the pair of semicircular beams defines a perimeter of an imaginary sphere between the top and bottom braces in which the semicircular beams are locked in place to the top and bottom braces with the pair of bolts and nuts. This combination of elements makes it possible to angularly change the angles of each semicircular beam relative to the top and bottom braces by loosing the bolts and nuts in order to provide a user an infinite number of angles for use in exercising muscles with this exercise accessory device attached to an exercise machine.

Still another object of the present invention is to provide a kit comprising the unassembled components of the device.

Lastly, it is an object of the present invention to provide a new and improved method of using comprising the steps of adjoining, affixing, joining, linking, obtaining, positioning, pushing, securing, sliding, and threading.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
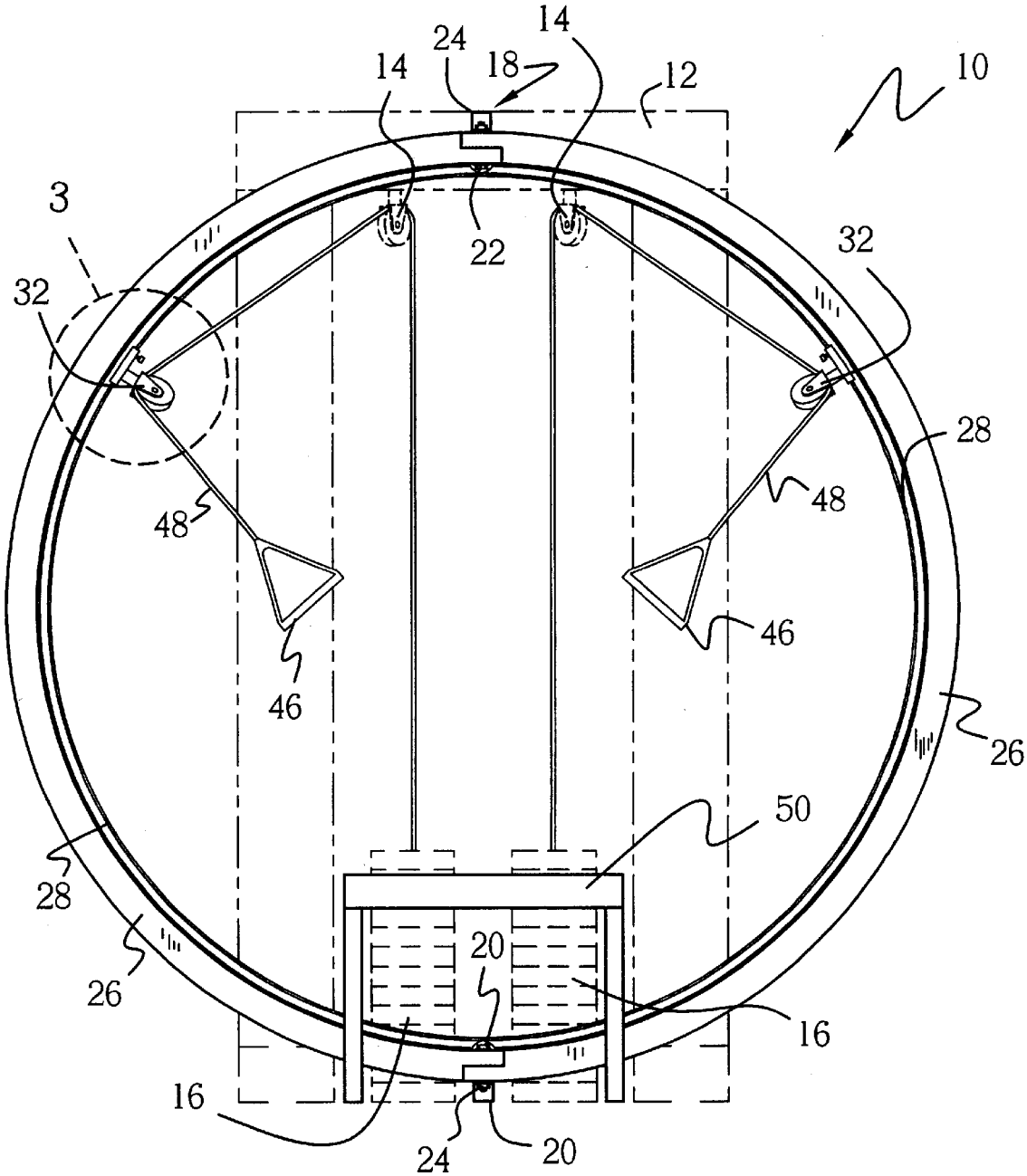
FIG. 1 is a front plan view of a preferred embodiment of the exercise accessory device constructed in accordance with the principles of the present invention.

Referring now to the drawings, and in particular FIGS. 1 to 4 thereof, one preferred embodiment of the present invention is shown and generally designated by the reference numeral 10. One preferred embodiment of an exercise accessory device 10 for attachment to an exercise machine 12, wherein the exercise machine 12 having at least two upper pulleys 14 connected to a resistive force element 16 via a system of wire ropes, the device 10 comprises a top brace 18, a bottom brace 20, a pair of bolts 22 and nuts 24, a pair of semicircular beams 26, a pair of track pulleys 32, a pair of handle grips 46, and a pair of cables 48. The top brace 18 is attachable to a top portion of the exercise machine 12. The bottom brace 20 is attachable to a bottom portion of the exercise machine 12. The pair of semicircular beams 26 is pivotally attached to the top and bottom braces (18 and 20, respectively), in which the pair of semicircular beams 26 define a perimeter of an imaginary sphere between the top and bottom braces (18 and 20, respectively) when the pair of semicircular beams 26 are pivotally rotated between the top and bottom braces (18 and 20, respectively). The pair of semicircular beams 26 are locked in place relative to the top and bottom braces (18 and 20, respectively) with the pair of bolts 22 and nuts 24 securely connecting together the pair of semicircular beams 26 to the top and bottom braces (18 and 20, respectively). Each semicircular beam 26 has an inside edge comprising a slide rail 28 with a plurality of holes 30 traversing into the inside edge of each semicircular beam 26. The each track pulley 32 includes a slide track base 34, a lock pin 36, a swivel arm 38, a yoke 40, an axle 42, and a wheel 44. The slide track base 34 has a collar defining an orifice extending through the slide track base 34. The slide track base 34 is slidably attached to the slide rail 28 of anyone semicircular beam 26 of the pair of semicircular beams 26. The lock pin 36 has a distal and proximate ends, in which the lock pin 36 is slidably attached to the collar of the slide track base 34. The lock pin 36 traverses through the orifice of the slide track base 34 with the distal end of the lock pin 36 extending outwardly from the slide track base 34, wherein the distal end of the lock pin 36 is slidably insertable into anyone hole 30 of the plurality of holes 30 of anyone semicircular beam 26 of the pair of semicircular beams 26. The swivel arm 38 is attached to the slide track base 34. The yoke 40 is attached to the swivel arm 38. The axle 42 is attached to the yoke 40. The wheel 44 is attached to the axle 42. Each cable 48 has a distal end, a proximate end and a middle portion, in which the distal end of each cable 48 is attached to the resistive force element 16 of the exercise machine 12. The proximate end of each cable 48 is attached to anyone handle grip 46 of the pair of handle grips 46. The middle portion of each cable 48 is slidably connected to anyone track pulley 32 of the pair of track pulleys 32 and slidably connected to anyone upper pulley 14 of the pair of upper pulleys 14s of the exercise machine 12.

One preferred configuration of the resistive force element 16 of the optional exercise machine 12 comprises a plurality of weights. Another preferred configuration of the resistive force element 16 of the optional exercise machine 12 comprises a pressure shock. Yet another preferred configuration of the resistive force element 16 of the optional exercise machine 12 comprises a tensile spring. Still yet another preferred configuration of the resistive force element 16 of the optional exercise machine 12 comprises a bendable shaft.

The swivel arm 38 of each corresponding track pulley 32 of the device 10 may be firmly attached to the slide track base 34 of each corresponding track pulley 32. Another preferred configuration of the swivel arm 38 of each corresponding track pulley 32 is that it is pivotally attached to the slide track base 34 of each corresponding track pulley 32.

The yoke 40 of each corresponding track pulley 32 of the device 10 may be firmly attached to the slide track base 34 of each corresponding track pulley 32. Another preferred configuration of the yoke 40 of each corresponding track pulley 32 is that it is pivotally attached to the swivel arm 38 of each corresponding track pulley 32.

An optional bench 50 may be added to the device 10. The bench 50 is positionable between the top brace 18 and the bottom brace 20.

An optional exercise machine 12 may be added to the device 10 wherein the top brace 18 is attached to the top portion of the exercise machine 12 and the bottom brace 20 is attached to the bottom portion of the exercise machine 12.

An optional pair of washers 52 may be added to the device 10, wherein each washer 52 is slidably attached between any bolt 22 and nut 24 of the pair of bolts 22 and nuts 24.

One preferred embodiment of an exercise accessory kit for attachment to an exercise machine 12, wherein the exercise machine 12 having at least two upper pulleys 14s connected to a resistive force element 16 via a system of wire ropes, the kit comprises a top brace 18, a bottom brace 20, a pair of bolts 22 and nuts 24, a pair of semicircular beams 26, a pair of track pulleys 32, a pair of handle grips 46, and a pair of cables 48. The top brace 18 is attachable to a top portion of the exercise machine 12. The bottom brace 20 is attachable to a bottom portion of the exercise machine 12. The pair of semicircular beams 26 is pivotally attachable to the top and bottom braces (18 and 20, respectively), in which the pair of semicircular beams 26 defines a perimeter of an imaginary sphere between the top and bottom braces (18 and 20, respectively) when the pair of semicircular beams 26 are pivotally rotated between the top and bottom braces (18 and 20, respectively). The pair of semicircular beams 26 are lockable in place relative to the top and bottom braces (18 and 20, respectively) when the pair of bolts 22 and nuts 24 securely connect together the pair of semicircular beams 26 to the top and bottom braces (18 and 20, respectively). Each semicircular beam 26 has an inside edge comprising a slide rail 28 with a plurality of holes 30 traversing into the inside edge of each semicircular beam 26. Each track pulley 32 includes a slide track base 34, a lock pin 36, a swivel arm 38, a yoke 40, an axle 42 and a wheel 44. The slide track base 34 has a collar defining an orifice extending through the slide track base 34, in which the slide track base 34 is slidably attachable to the slide rail 28 of anyone semicircular beam 26 of the pair of semicircular beams 26. The lock pin 36 has a distal and proximate ends, in which the lock pin 36 is slidably attached to the collar of the slide track base 34 through the orifice of the slide track base 34. The distal end of the lock pin 36 is slidably insertable into anyone hole 30 of the plurality of holes 30 of anyone semicircular beam 26 of the pair of semicircular beams 26. The swivel arm 38 is attached to the slide track base 34. The yoke 40 is attached to the swivel arm 38. The axle 42 is attached to the yoke 40. The wheel 44 is attached to the axle. Each cable 48 has a distal end, a proximate end and a middle portion. The distal end of each cable 48 is attachable to the resistive force element 16 of the exercise machine 12. The proximate end of each cable 48 is attachable to anyone handle grip 46 of the pair of handle grips 46. The middle portion of each cable 48 is slidably connectable to anyone track pulley 32 of the pair of track pulleys 32 and slidably connectable to anyone upper pulley 14 of the pair of upper pulleys 14 of the exercise machine 12.

The swivel arm 38 of each corresponding track pulley 32 of the kit may be firmly attached to the slide track base 34 of each corresponding track pulley 32. Another preferred configuration of the swivel arm 38 of each corresponding track pulley 32 is that it is pivotally attached to the slide track base 34 of each corresponding track pulley 32.

The yoke 40 of each corresponding track pulley 32 of the kit may be firmly attached to the slide track base 34 of each corresponding track pulley 32. Another preferred configuration of the yoke 40 of each corresponding track pulley 32 is that it is pivotally attached to the swivel arm 38 of each corresponding track pulley 32.

An optional bench 50 may be added to the kit.

An optional pair of washers 52 may be added to the kit in which each washer 52 is slidably attachable between any bolt 22 and nut 24 of the pair of bolts 22 and nuts 24.

A preferred embodiment of a method of using an exercise accessory kit for attachment to an exercise machine 12, wherein the exercise machine 12 having at least two upper pulleys 14s connected to a resistive force element 16 via a system of wire ropes, the method comprising the steps of adjoining, affixing, joining, linking, obtaining, positioning, pushing, securing, sliding, and threading. The obtaining step comprises obtaining the kit comprising: a top brace 18 attachable to a top portion of the exercise machine 12; a bottom brace 20 attachable to a bottom portion of the exercise machine 12; a pair of bolts 22 and nuts 24; a pair of semicircular beams 26 pivotally attachable to the top and bottom braces (18 and 20, respectively), the pair of semicircular beams 26 defining a perimeter of an imaginary sphere between the top and bottom braces (18 and 20, respectively) when the pair of semicircular beams 26 are pivotally rotated between the top and bottom braces (18 and 20, respectively), the pair of semicircular beams 26 are lockable in place relative to the top and bottom braces (18 and 20, respectively) when the pair of bolts 22 and nuts 24 securely connect together the pair of semicircular beams 26 to the top and bottom braces (18 and 20, respectively), each semicircular beam 26 having an inside edge comprising a slide rail 28 with a plurality of holes 30 traversing into the inside edge of each semicircular beam 26; a pair of track pulleys 32, each track pulley 32 including: a slide track base 34 having a collar defining an orifice extending through the slide track base 34, the slide track base 34 is slidably attachable to the slide rail 28 of anyone semicircular beam 26 of the pair of semicircular beams 26; a lock pin 36 having a distal and proximate ends, the lock pin 36 is slidably attached to the collar of the slide track base 34 through the orifice of the slide track base 34, the distal end of the lock pin 36 is slidably insertable into anyone hole 30 of the plurality of holes 30 of anyone semicircular beam 26 of the pair of semicircular beams 26; a swivel arm 38 attached to the slide track base 34; a yoke 40 attached to the swivel arm 38; an axle 42 attached to the yoke 40; and a wheel 44 attached to the axle 42; a pair of handle grips 46; a pair of cables 48, each cable 48 having a distal end, a proximate end and a middle portion, the distal end of each cable 48 is attachable to the resistive force element 16 of the exercise machine 12, the proximate end of each cable 48 is attachable to anyone handle grip 46 of the pair of handle grips 46, the middle portion of each cable 48 is slidably connectable to anyone track pulley 32 of the pair of track pulleys 32 and slidably connectable to anyone upper pulley 14 of the pair of upper pulleys 14*s* of the exercise machine 12; and a bench 50. The adjoining step comprises adjoining together the top brace 18 to the top portion of the exercise machine 12, the adjoining step performed subsequent to the obtaining step. The affixing step comprises affixing together the bottom brace 20 to the bottom portion of the exercise machine 12, the affixing step performed subsequent to the obtaining step. The sliding step comprises sliding separately each track pulley 32 of the pair of track pulleys 32 onto each corresponding semicircular beam 26 of the pair of semicircular beams 26 by aligning the slide track base 34 of each track pulley 32 of the pair of track pulleys 32 onto the slide rail 28 of each corresponding semicircular beam 26 of the pair of semicircular beams 26, the sliding step performed subsequent to the obtaining step. The pushing step comprises pushing the proximate end of each lock pin 36 of each track pulley 32 of the pair of track pulleys 32 so that the corresponding distal end of each lock pin 36 on each track pulley 32 of the pair of track pulleys 32 slides into anyone of the holes 30 of the plurality of holes 30 of each corresponding semicircular beam 26 of the pair of semicircular beams 26, the pushing step performed subsequent to the sliding step. The securing step comprises securing together the pair of semicircular beams 26 to the top and bottom braces (18 and 20, respectively) with the pair of bolts 22 and nuts 24, the securing step performed subsequent to the adjoining, affixing, and sliding steps. The joining step comprises joining together proximate end of each cable 48 of the pair of cables 48 to each corresponding handle grip 46 of the pair of handle grips 46, the joining step performed subsequent to the obtaining step. The threading step comprises threading together the distal end of each cable 48 of the pair of cables 48 through each corresponding track pulley 32 of the pair of track pulleys 32 and through each corresponding upper pulley 14 of the pair of upper pulleys 14s of the exercise machine 12 so that the middle portion of each cable 48 of the pair of cables 48 is slidably connected to each corresponding track pulley 32 of the pair of track pulleys 32 and to each corresponding upper pulley 14 of the pair of upper pulleys 14s of the exercise machine 12, the threading step performed subsequent to the securing step. The linking step comprises linking together the proximate end of each cable 48 of the pair of cables 48 onto the resistive force element 16 of the exercise machine 12, the linking step performed subsequent to the securing step. The positioning step comprises positioning the bench 50 between the top and bottom braces (18 and 20, respectively) so that a portion of the bench 50 is within the imaginary sphere defined by the pair of semicircular beams 26 pivotally rotated between the top and bottom braces (18 and 20, respectively), the positioning step performed subsequent to the linking, joining, and threading steps.

Figure 2:
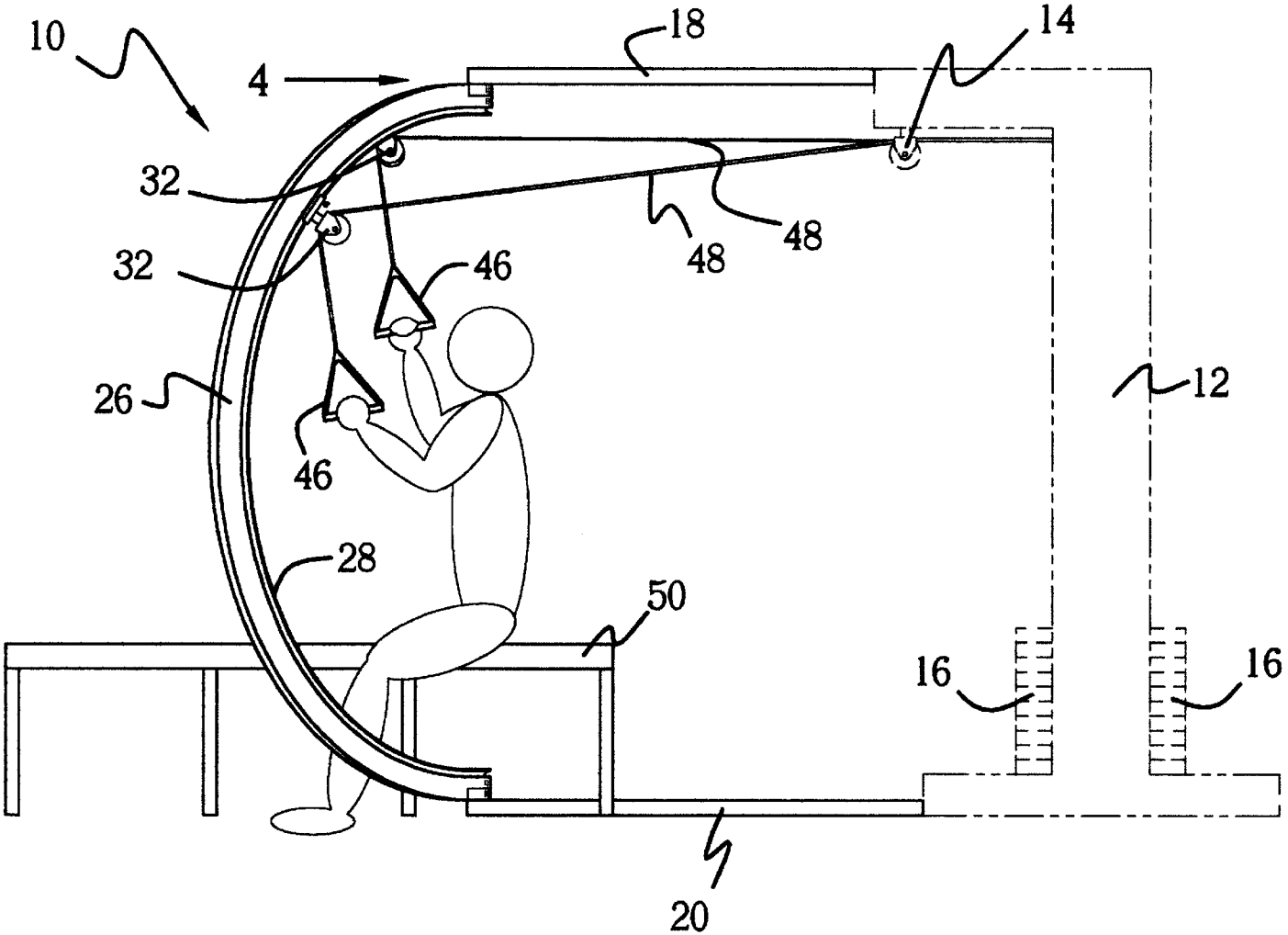
FIG. 2 is a side plan view of a preferred embodiment of the exercise accessory device of the present invention.

Referring now to FIG. 1 and FIG. 2 which depict a front and side plan views of an preferred embodiment of the exercise accessory device 10 showing the device 10 attached to an exercise machine 12. The exercise machine 12 is shown having at least two upper pulleys 14 connected to a resistive force element 16 via a system of wire ropes. The device 10 is shown comprising a top brace 18, a bottom brace 20, a pair of bolts 22 and nuts 24, a pair of semicircular beams 26, a pair of track pulleys 32, a pair of handle grips 46, a pair of cables 48, and a bench 50. The top brace 18 is shown attachable to a top portion of the exercise machine 12. The bottom brace 20 is shown attachable to a bottom portion of the exercise machine 12. The pair of semicircular beams 26 is shown pivotally attached to the top and bottom braces (18 and 20, respectively), in which the pair of semicircular beams 26 define a perimeter of an imaginary sphere between the top and bottom braces (18 and 20, respectively) when the pair of semicircular beams 26 are pivotally rotated between the top and bottom braces (18 and 20, respectively). The pair of semicircular beams 26 are shown locked in place relative to the top and bottom braces (18 and 20, respectively) with the pair of bolts 22 and nuts 24 securely connecting together the pair of semicircular beams 26 to the top and bottom braces (18 and 20, respectively). Each semicircular beam 26 is shown to have an inside edge comprising a slide rail 28. The distal end of each cable 48 is shown attached to the resistive force element 16 of the exercise machine 12. The proximate end of each cable 48 is shown attached to anyone handle grip 46 of the pair of handle grips 46. The middle portion of each cable 48 is shown slidably connected to anyone track pulley 32 of the pair of track pulleys 32 and slidably connected to anyone upper pulley 14 of the pair of upper pulleys 14 of the exercise machine 12. The bench 50 is shown positioned between the top brace 18 and the bottom brace 20.

Figure 3:
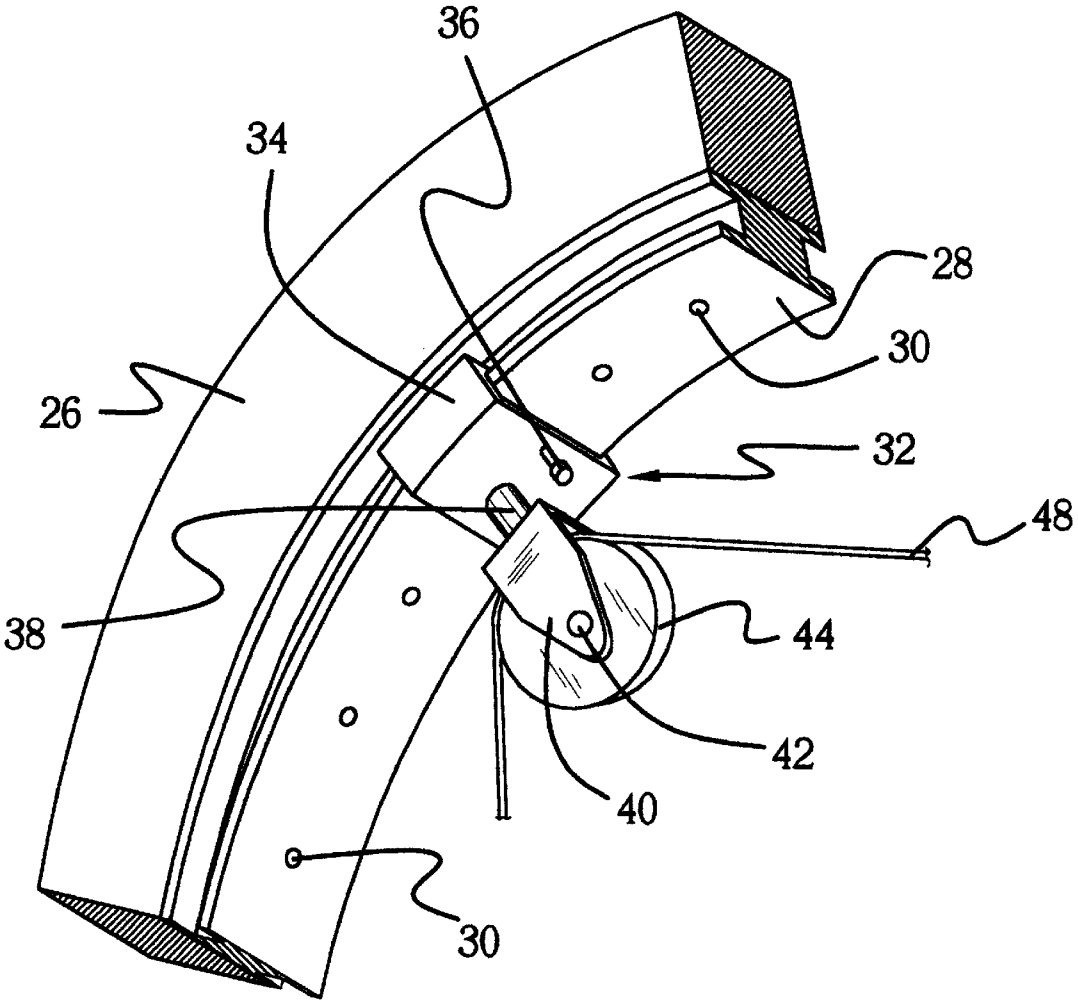
FIG. 3 is a perspective partial view of a preferred embodiment of the exercise accessory device of the present invention.

Refer now to FIG. 3, which is a perspective partial close up view of a preferred embodiment of the exercise accessory device 10 showing a track pulley 32 slidably attached to a semicircular beam 26. The semicircular beam 26 is shown having an inside edge comprising a slide rail 28 with a plurality of holes 30 traversing into the inside edge of each semicircular beam 26.

The track pulley 32 is shown having a slide track base 34, a lock pin 36, a swivel arm 38, a yoke 40, an axle 42, and a wheel 44. The slide track base 34 is shown having a collar defining an orifice extending through the slide track base 34. The slide track base 34 is shown slidably attached to the slide rail 28 of anyone semicircular beam 26 of the pair of semicircular beams 26. The lock pin 36 is shown having a distal and proximate ends, in which the lock pin 36 is shown slidably attached to the collar of the slide track base 34. The lock pin 36 traverses through the orifice of the slide track base 34 with the distal end of the lock pin 36 extending outwardly from the slide track base 34, wherein the distal end of the lock pin 36 is slidably insertable into anyone hole 30 of the plurality of holes 30 of anyone semicircular beam 26 of the pair of semicircular beams 26. The swivel arm 38 is shown attached to the slide track base 34. The yoke 40 is shown attached to the swivel arm 38. The axle 42 is shown attached to the yoke 40. The wheel 44 is shown attached to the axle 42.

Figure 4:
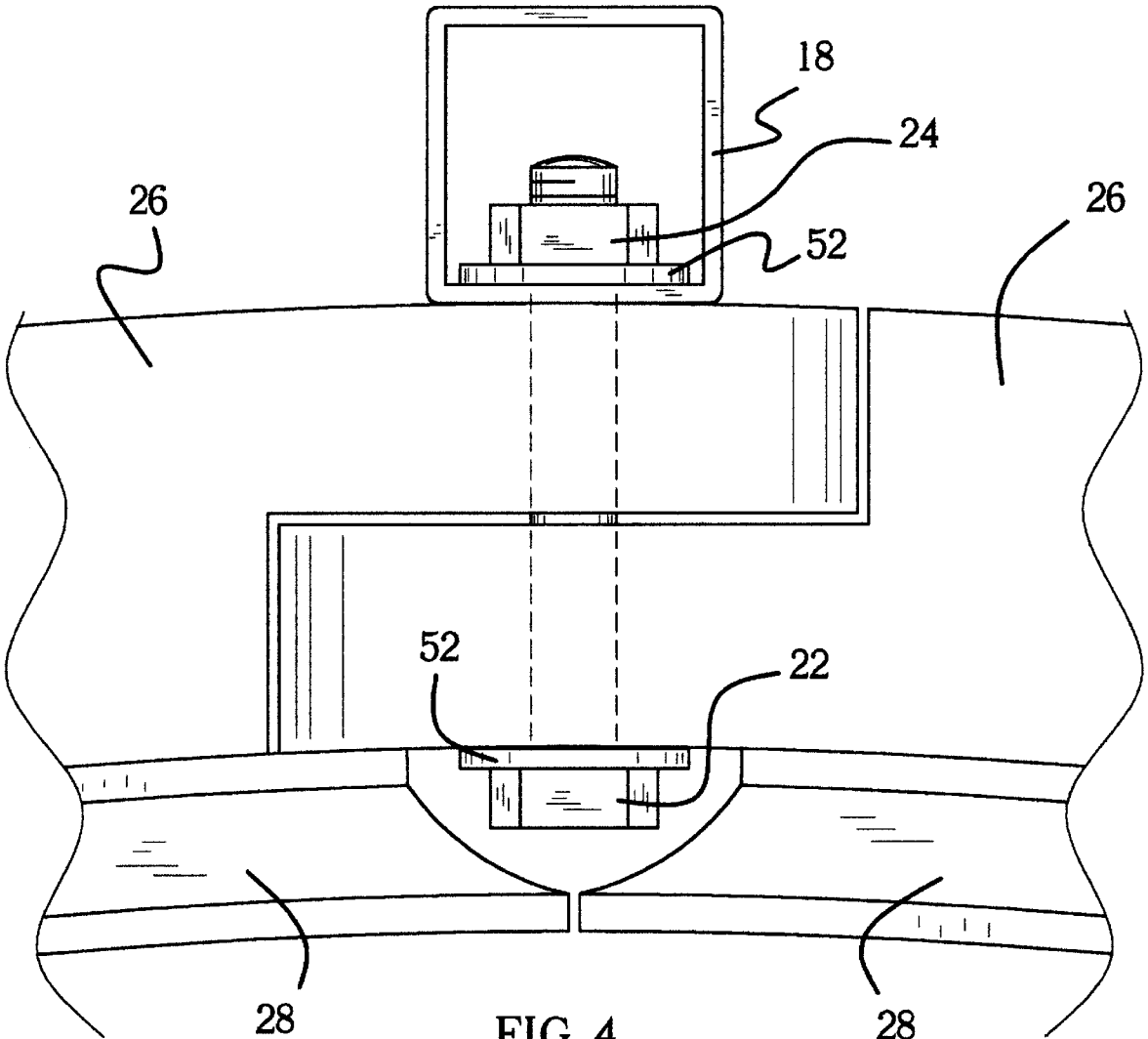
FIG. 4 is a front partial view of a preferred embodiment of the exercise accessory device of the present invention.

Referring now to FIG. 4 is a front closeup partial view of a preferred embodiment of the exercise accessory device 10 showing how the pair of semicircular beams 26 are attached to the top brace 18 via the bolt 22 and nut 24.

As to the manner of usage and operation of the present invention, the same should be apparent from the above description. Accordingly, no further discussion relating to the manner of usage and operation will be provided.

While a preferred embodiment of the exercise accessory device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise accessory device for attachment to an exercise machine, wherein the exercise machine having at least two upper pulleys connected to a resistive force element via a system of wire ropes, said device comprising:

a top brace attachable to a top portion of the exercise machine;

a bottom brace attachable to a bottom portion of the exercise machine;

a pair of bolts and nuts;

a pair of semicircular beams pivotally attached to said top and bottom braces, said pair of semicircular beams defining a perimeter of an imaginary sphere between said top and bottom braces when said pair of semicircular beams are pivotally rotated between said top and bottom braces, said pair of semicircular beams are locked in place relative to said top and bottom braces with said pair of bolts and nuts securely connecting together said pair of semicircular beams to said top and bottom braces, each semicircular beam having an inside edge comprising a slide rail with a plurality of holes traversing into said inside edge of each semicircular beam;

a pair of track pulleys, each track pulley including:

a slide track base having a collar defining an orifice extending through said slide track base, said slide track base is slidably attached to said slide rail of anyone semicircular beam of said pair of semicircular beams;

a lock pin having a distal and proximate ends, said lock pin is slidably attached to said collar of said slide track base, said lock pin traversing through the orifice of said slide track base with the distal end of said lock pin extending outwardly from said slide track base, the distal end of said lock pin is slidably insertable into anyone hole of said plurality of holes of anyone semicircular beam of said pair of semicircular beams;

a swivel arm attached to said slide track base;

a yoke attached to said swivel arm;

an axle attached to said yoke; and a wheel attached to said axle;

a pair of handle grips; and a pair of cables, each cable having a distal end, a proximate end and a middle portion, the distal end of each cable is attached to the resistive force element of the exercise machine, the proximate end of each cable is attached to anyone handle grip of said pair of handle grips, the middle portion of each cable is slidably connected to anyone track pulley of said pair of track pulleys and slidably connected to anyone upper pulley of the pair of upper pulleys of the exercise machine.

2. The device of claim 1 further comprising a bench.

3. The device of claim 1 further comprising the exercise machine wherein said top brace is attached to the top portion of the exercise machine and said bottom brace is attached to the bottom portion of the exercise machine.

4. The device of claim 3 wherein the resistive force element of the exercise machine comprises a plurality of weights.

5. The device of claim 3 wherein the resistive force element of the exercise machine comprises a pressure shock.

6. The device of claim 3 wherein the resistive force element of the exercise machine comprises a tensile spring.

7. The device of claim 3 wherein the resistive force element of the exercise machine comprises a bendable shaft.

8. The device of claim 1 further comprising a pair of washers, each washer is slidably attached between any bolt and nut of said pair of bolts and nuts.

9. The device of claim 1 wherein said swivel arm of each corresponding track pulley is pivotally attached to said slide track base of each corresponding track pulley.

10. The device of claim 1 wherein said yoke of each corresponding track pulley is pivotally attached to said swivel arm of each corresponding track pulley.

11. An exercise accessory kit for attachment to an exercise machine, wherein the exercise machine having at least two upper pulleys connected to a resistive force element via a system of wire ropes, said kit comprising:

a top brace attachable to a top portion of the exercise machine;

a bottom brace attachable to a bottom portion of the exercise machine;

a pair of bolts and nuts;

a pair of semicircular beams pivotally attachable to said top and bottom braces, said pair of semicircular beams defining a perimeter of an imaginary sphere between said top and bottom braces when said pair of semicircular beams are pivotally rotated between said top and bottom braces, said pair of semicircular beams are lockable in place relative to said top and bottom braces when said pair of bolts and nuts securely connect together said pair of semicircular beams to said top and bottom braces, each semicircular beam having an inside edge comprising a slide rail with a plurality of holes traversing into said inside edge of each semicircular beam;

a pair of track pulleys, each track pulley including:

a slide track base having a collar defining an orifice extending through said slide track base, said slide track base is slidably attachable to said slide rail of anyone semicircular beam of said pair of semicircular beams;

a lock pin having a distal and proximate ends, said lock pin is slidably attached to said collar of said slide track base through the orifice of said slide track base, the distal end of said lock pin is slidably insertable into anyone hole of said plurality of holes of anyone semicircular beam of said pair of semicircular beams;

a swivel arm attached to said slide track base;

a yoke attached to said swivel arm;

an axle attached to said yoke; and a wheel attached to said axle;

a pair of handle grips; and a pair of cables, each cable having a distal end, a proximate end and a middle portion, the distal end of each cable is attachable to the resistive force element of the exercise machine, the proximate end of each cable is attachable to anyone handle grip of said pair of handle grips, the middle portion of each cable is slidably connectable to anyone track pulley of said pair of track pulleys and slidably connectable to anyone upper pulley of the pair of upper pulleys of the exercise machine.

12. The kit of claim 11 further comprising a bench.

13. The kit of claim 11 further comprising a pair of washers, each washer is slidably attachable between any bolt and nut of said pair of bolts and nuts.

14. The kit of claim 11 wherein said swivel arm of each corresponding track pulley is pivotally attached to said slide track base of each corresponding track pulley.

15. The kit of claim 11 wherein said yoke of each corresponding track pulley is pivotally attached to said swivel arm of each corresponding track pulley.

16. A method of using an exercise accessory kit for attachment to an exercise machine, wherein the exercise machine having at least two upper pulleys connected to a resistive force element via a system of wire ropes, said method comprising the steps of: obtaining the kit comprising:

a top brace attachable to a top portion of the exercise machine;

a bottom brace attachable to a bottom portion of the exercise machine;

a pair of bolts and nuts;

a pair of semicircular beams pivotally attachable to the top and bottom braces, the pair of semicircular beams defining a perimeter of an imaginary sphere between the top and bottom braces when the pair of semicircular beams are pivotally rotated between the top and bottom braces, the pair of semicircular beams are lockable in place relative to the top and bottom braces when the pair of bolts and nuts securely connect together the pair of semicircular beams to the top and bottom braces, each semicircular beam having an inside edge comprising a slide rail with a plurality of holes traversing into the inside edge of each semicircular beam;

a pair of track pulleys, each track pulley including:

a slide track base having a collar defining an orifice extending through the slide track base, the slide track base is slidably attachable to the slide rail of anyone semicircular beam of the pair of semicircular beams;

a lock pin having a distal and proximate ends, the lock pin is slidably attached to the collar of the slide track base through the orifice of the slide track base, the distal end of the lock pin is slidably insertable into anyone hole of the plurality of holes of anyone semicircular beam of the pair of semicircular beams;

a swivel arm attached to the slide track base;

a yoke attached to the swivel arm;

an axle attached to the yoke; and a wheel attached to the axle;

a pair of handle grips;

a pair of cables, each cable having a distal end, a proximate end and a middle portion, the distal end of each cable is attachable to the resistive force element of the exercise machine, the proximate end of each cable is attachable to anyone handle grip of the pair of handle grips, the middle portion of each cable is slidably connectable to anyone track pulley of the pair of track pulleys and slidably connectable to anyone upper pulley of the pair of upper pulleys of the exercise machine; and a bench;

adjoining together the top brace to the top portion of the exercise machine, said adjoining step performed subsequent to said obtaining step;

affixing together the bottom brace to the bottom portion of the exercise machine, said affixing step performed subsequent to said obtaining step;

sliding separately each track pulley of the pair of track pulleys onto each corresponding semicircular beam of the pair of semicircular beams by aligning the slide track base of each track pulley of the pair of track pulleys onto the slide rail of each corresponding semicircular beam of the pair of semicircular beams, said sliding step performed subsequent to said obtaining step;

pushing the proximate end of each lock pin of each track pulley of the pair of track pulleys so that the corresponding distal end of each lock pin on each track pulley of the pair of track pulleys slides into anyone of the holes of the plurality of holes of each corresponding semicircular beam of the pair of semicircular beams, said pushing step performed subsequent to said sliding step;

securing together the pair of semicircular beams to the top and bottom braces with the pair of bolts and nuts, said securing step performed subsequent to said adjoining, affixing, and sliding steps;

joining together proximate end of each cable of the pair of cables to each corresponding handle grip of the pair of handle grips, said joining step performed subsequent to said obtaining step;

threading together the distal end of each cable of the pair of cables through each corresponding track pulley of the pair of track pulleys and through each corresponding upper pulley of the pair of upper pulleys of the exercise machine so that the middle portion of each cable of the pair of cables is slidably connected to each corresponding track pulley of the pair of track pulleys and to each corresponding upper pulley of the pair of upper pulleys of the exercise machine, said threading step performed subsequent to said securing step;

linking together the proximate end of each cable of the pair of cables onto the resistive force element of the exercise machine, said linking step performed subsequent to said securing step; and positioning the bench between the top and bottom braces so that a portion of the bench is within the imaginary sphere defined by the pair of semicircular beams pivotally rotated between the top and bottom braces, said positioning step performed subsequent to said linking, joining, and threading steps.

* * * * *